US005828009A

United States Patent [19]

James et al.

[11] Patent Number: 5,828,009

[45] Date of Patent: Oct. 27, 1998

[54] WIRING HARNESS BREAKOUT CLIP WITH A PAIR OF LOCATING POSTS AND FLEXIBLE RETAINING BANDS

[75] Inventors: Benjamin B. James, Birchrunville, Pa.; Denis van Wassenhove, Crepy-en-Valois, France

[73] Assignee: Bentley-Harris Inc., Exton, Pa.

[21] Appl. No.: 734,440

[22] Filed: Oct. 17, 1996

[51] Int. Cl.[6] ..... H01B 7/00

[52] U.S. Cl. ..... 174/135; 24/442; 248/743; 248/60

[58] Field of Search ..... 439/501; 174/71 R, 174/72 R, 72 A, 135, 154, 155, 156, 168, 161 R, 174; 24/306, 442; 248/205.2, 74.3, 60

[56] References Cited

U.S. PATENT DOCUMENTS

| | | | |
|---|---|---|---|
| 3,346,688 | 10/1967 | Fields | 174/68.3 |
| 3,711,633 | 1/1973 | Ghirardi et al. | 174/135 |
| 3,861,015 | 1/1975 | Hooven | 29/755 |
| 3,949,457 | 4/1976 | Fortsch | 29/755 |
| 3,984,622 | 10/1976 | Ross | 174/72 A |
| 4,379,537 | 4/1983 | Perrault et al. | 248/74.3 |
| 4,410,379 | 10/1983 | Franckx | 156/54 |
| 4,424,627 | 1/1984 | Tarbox | 29/857 |
| 4,797,512 | 1/1989 | Kumagai et al. | 174/135 |
| 5,048,158 | 9/1991 | Koerner | 24/16 R |
| 5,168,603 | 12/1992 | Reed | 24/16 R |
| 5,352,855 | 10/1994 | Potter | 174/135 |
| 5,362,018 | 11/1994 | Darr et al. | 248/74.3 |
| 5,367,126 | 11/1994 | Kikuchi | 174/71 R |
| 5,394,502 | 2/1995 | Caron | 385/134 |
| 5,620,158 | 4/1997 | Rondondi et al. | 248/69 |

FOREIGN PATENT DOCUMENTS

| | | | |
|---|---|---|---|
| 1590764 | 6/1970 | Germany | 174/72 A |
| 2357728 | 5/1975 | Germany | 174/72 A |
| 1078193 | 8/1967 | United Kingdom | 174/72 A |

*Primary Examiner*—Kristine L. Kincaid
*Assistant Examiner*—Kamand Cuneo
*Attorney, Agent, or Firm*—Synnestvedt & Lechner

[57] ABSTRACT

A wiring harness breakout clip for forming and supporting the trunk and branch portions of a wire bundle from a wiring harness is provided. The harness breakout clip mounts on a support surface and includes: a substantially rigid plate for supporting the trunk portion of the wire bundle; locating posts joined to and projecting from the plate, the locating posts being spaced apart to form a locating space for a branch portion of the wire bundle; and flexible straps joined to the plate in adjacent relation to the locating posts for fastening the wire bundle to the plate. In an alternative embodiment, the flexible straps have internesting intermediate and proximal sections and distal sections. The intermediate sections nest within recesses in the proximal sections and the distal sections nest within recesses in the internested sections. Laterally extending interengagable points or barbs on each section fasten the sections together when the intermediate section is looped around a wire bundle and nested in the recess in the proximal section, and the distal section is looped around a second wire bundle and nested in the recess in the intermediate section. The plate may be divided into separate sections joined together by yieldable members which allow for variations in the width of the locating space.

14 Claims, 6 Drawing Sheets

WIRING HARNESS BREAKOUT CLIP WITH A PAIR OF LOCATING POSTS AND FLEXIBLE RETAINING BANDS

FIELD OF THE INVENTION

This invention relates to wiring harnesses and, more particularly, to a device useful for the manufacturing of wiring harnesses. Wiring harnesses of the kind the invention is concerned with are used in electrical applications, and particularly in automotive, nautical and aeronautical fields.

BACKGROUND OF THE INVENTION

In applications of the type referred to above, it is necessary for one or more wires to be separated (to form a "branch") at various junction ("breakout") points from a bundle of wires (a "trunk") to allow for routing of branches at various locations along the length of the trunk. Such harnesses are conventionally assembled on a wiring or layout board having pins, nails or pegs which are positioned at the breakout points to guide the operator in proper assembling of the harness. Once the wires forming the trunk and branches are properly splayed on the board, a lacing tape is used to bind together the bundles of wires. The wires are then removed from the layout board so that another harness may be assembled. Such a configuration is shown, for example, in U.S. Pat. No. 3,861,015 issued to Hooven on Jan. 21, 1975. Knotted lacing tape is shown in the '015 patent but current practice makes use of multiple wraps of vinyl tape to bind a bundle of wires together. The repetitive motion required to secure a bundle in this fashion is time consuming and has a tendency to cause muscular or nerve injuries in the wrists and hands of the wiring harness assembler.

In addition, any such configuration fails to provide post-assembly support for the trunk and branch junction. Such post-assembly support is of considerable importance when the harnesses will be used in connection with just-in-time production applications in which harnesses may be assembled at one location, installed in an end product at another location, and subjected to vibration, motion or handling during transport between locations. Post-assembly support is also of considerable importance when the end product in which the harness is to be installed is an airplane, boat, automobile or other object in which the harness may be subjected to vibration or motion.

In accordance with further developments in the art, flexible junction devices have been used to retain the trunk portion and single branch wire strands. For example, such junction devices used for relatively small diameter communications wires are disclosed in U.S. Pat. No. 3,949,457 issued to Fortsch on Apr. 13, 1976 and U.S. Pat. No. 4,424,627 issued to Tarbox on Jan. 10, 1984. In addition, the '627 patent discloses a reusable strap support. This reusable device may be attached to the wiring board at suitable locations to provide a temporary holder for the junction device during harness assembly.

It is also known in the art to accommodate a branch of a plurality of wires as is shown in U.S. Pat. No. 5,352,855 issued to Potter on Oct. 4, 1994. The '855 patent discloses a flexible molded plastic junction clamp having flexible wire ties which may be used in conjunction with wire-enclosing sleeves to form generally T-shaped trunk and branch junctions.

A device for forming a branch from a trunk of wires which is enclosed in a corrugated cover tube is disclosed in U.S. Pat. No. 5,367,126 issued to Kikuchi on Nov. 22, 1994. The '126 patent teaches the use of a device which is attached with tape to a trunk wire bundle containing cover tube so as to create an opening through which a branch line is drawn from the trunk line. According to the teachings of the '126 patent, the branch line is then fastened with tape to a branch line supporting pillar which projects at a particular angle in relation to the trunk line.

The junction devices of the type heretofore known have failed to provide an integrated device which can at once provide for convenient forming of the trunk and branch portions of a wiring harness, allow for proper location of a breakout point in relation to a wiring board or the length of the trunk, accommodate multiple trunk and branch portions, allow for assembly of a harness in multiple stages, provide support to the harness after assembly, and allow for proper location of the harness during final installation in a product. In addition, the prior art devices fail to provide the desired level of versatility, economy of manufacture and ease of use.

SUMMARY AND OBJECTS OF THE INVENTION

Accordingly, it is an object of the present invention to provide a versatile harness breakout clip which may be used in conjunction with a layout board for conveniently forming and locating trunk and branch portions of a wire bundle comprising a wiring harness during harness assembly.

Another object of the present invention is to provide a harness breakout clip which may be conveniently mounted on a support surface.

Another object of the present invention is to provide post-assembly support for the junction of the trunk and branch portions of the wiring harness during transport of the harness between the harness assembly location and the location at which the harness is to be installed in an end product.

Another object of the present invention is to provide post-assembly support for the junction of the trunk and branch portions of the wiring harness after the harness has been installed in an end product.

It is a further object of the present invention to provide a wiring harness breakout clip, usable in conjunction with a method of constructing wiring harnesses by which a wire bundle may be secured and a wiring harness may be formed while reducing the need for repetitive wrapping motions and the resulting muscular and nerve injuries to harness assemblers.

It is yet a further object of the present invention to provide a harness breakout clip, usable in conjunction with a method by which wiring harness assembly may be performed in multiple stages and in which multiple trunk and branch wire bundles may be formed and retained on the same clip.

It is yet another object of the present invention to provide a harness breakout clip which lowers production costs and allows for quick wiring harness assembly to meet the demands of just-in-time production applications, particularly just-in-time automotive production applications.

These and other objects can be achieved by the provision of a wire bundle harness breakout clip comprising: a substantially rigid plate for supporting the trunk portion of a wire bundle; a pair of locating posts joined to and projecting from the plate, the locating posts being spaced apart to form a locating space for a branch portion of said wire bundle; and flexible wrapper means joined to the plate in adjacent relation to the locating posts.

These and other objects are further achieved by the provision of a wiring harness breakout clip adapted for use with a wiring harness layout board, and means for removably mounting the wiring harness breakout clip to the wiring harness layout board.

BRIEF DESCRIPTION OF THE DRAWINGS

Various objects, features, aspects and advantages of the present invention will become better understood with reference to the following description taken with the accompanying drawings, in which.

DETAILED DESCRIPTION OF THE PREFERRED EMBODIMENT OF THE INVENTION

Figure 1:
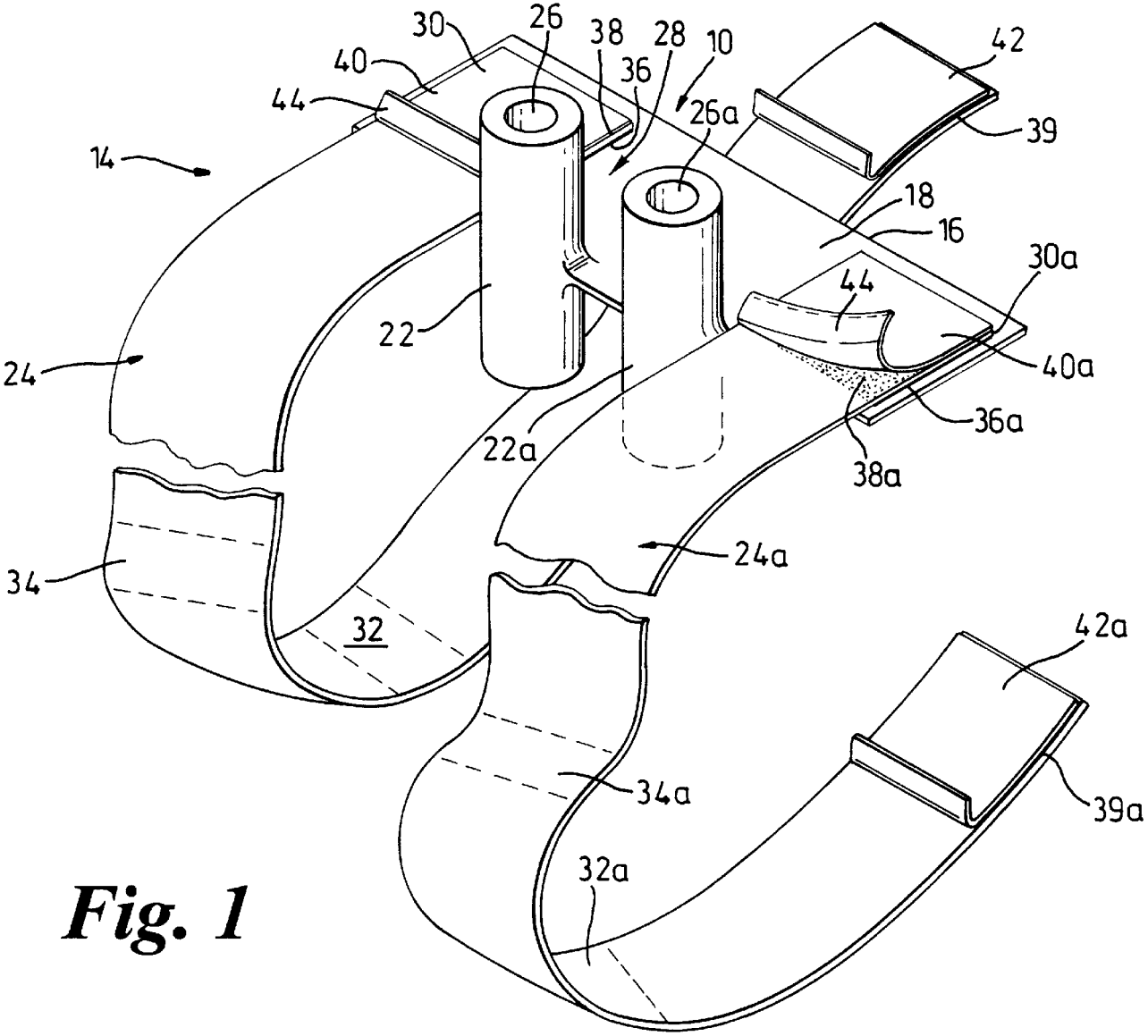
FIG. 1 is a perspective view of a first embodiment of a harness breakout clip according to the invention.
Figure 2:
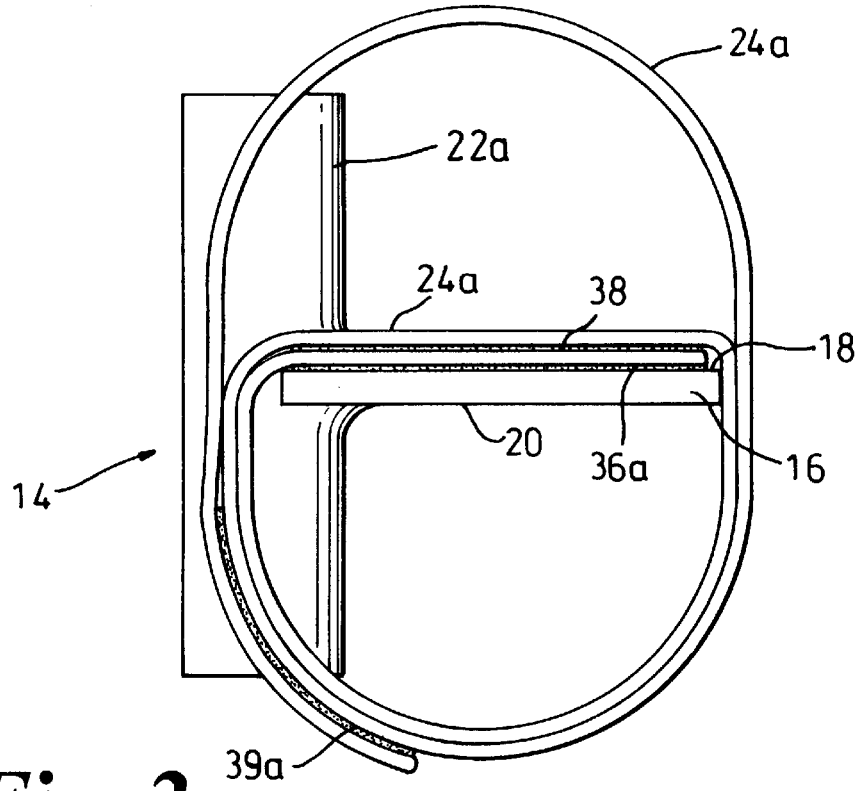
FIG. 2 is an elevational view of the first embodiment illustrated in FIG. 1 after wire bundles have been secured on both sides of the plate with the wire bundles eliminated for purposes of illustration.
Figure 3:
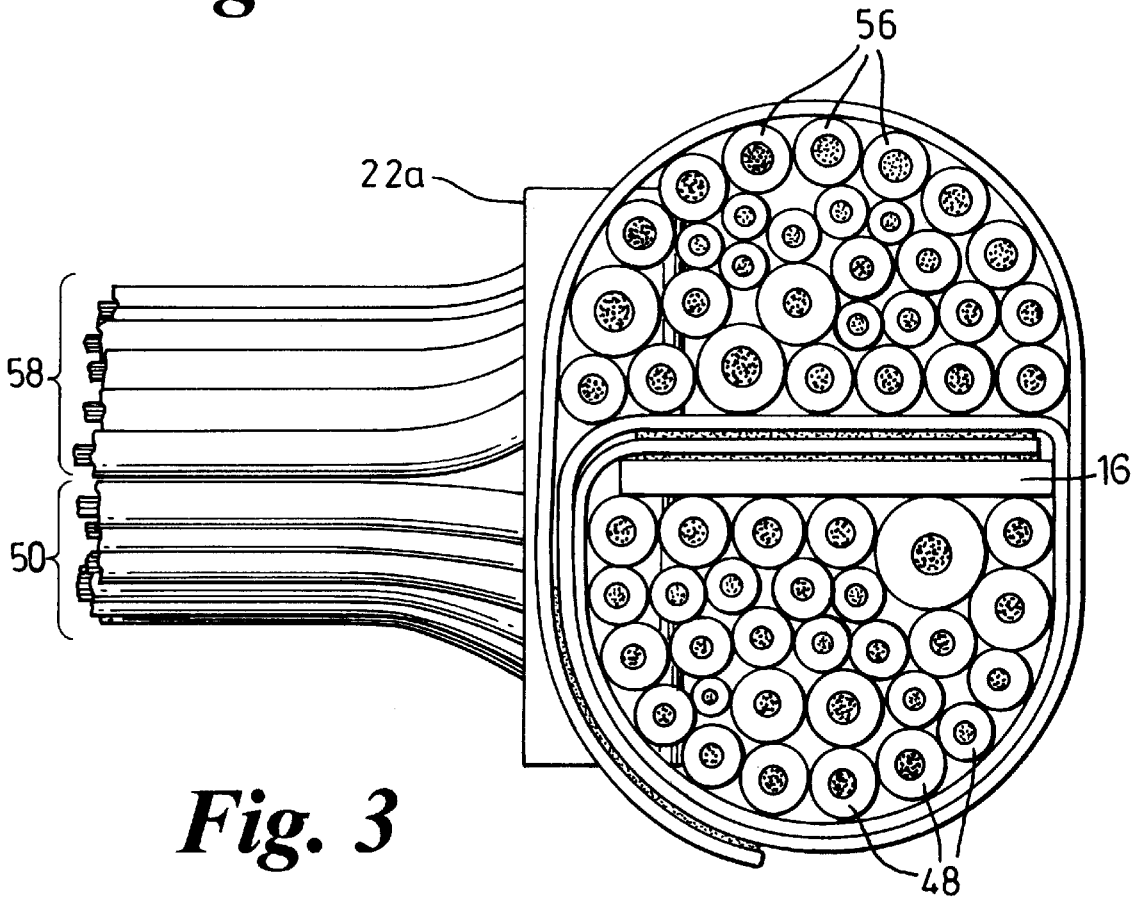
FIG. 3 is an elevational view of the first embodiment illustrated in FIG. 1 after wire bundles have been secured on both sides of the plate with the wire bundles illustrated.

Referring now particularly to FIGS. 1–3, a harness breakout clip 14 made according to the teachings of the present invention comprises a substantially rigid plate 16 having a first side 18 and a second side 20. Plate 16 is preferably made of a relatively stiff but deformable plastic material such as polyamide. Locating posts 22, 22*a* extend from the plate and are joined thereto. Elongated flexible securing straps 24 and 24*a* are secured to the plate 16, as, for example, on side 18, and are dimensioned to allow for wrapping of each strap around a wire bundle to secure the bundle to the plate. In the embodiment of FIGS. 1–3, locating posts 22, 22*a* project from both sides of the plate, as best shown in FIG. 1, and are preferably integrally joined to the plate, as by molding, immediately adjacent one of its edge surfaces. In addition, locating posts 22, 22*a* preferably have longitudinally extended through bores 26, 26*a* to allow for receipt of mounting pins projecting from a mounting surface such as a layout board. The locating posts 22, 22*a* are separated to form locating spaces 28 to locate breakout points relative to the first and second sides of the plate 16.

As shown in FIGS. 1, an end 30, 30*a* of each flexible securing strap 24, 24*a* is attached to the first side 18 of the plate in transverse relationship to the plate and preferably outboard of posts 22, 22*a*. The flexible securing straps may be attached to the plate by strap attachment adhesive patches 36, 36*a*. Alternatively, the flexible securing straps may be integrally molded with the plate or attached to the plate by suitable means, such as by ultrasonic welding or by use of hook and loop fastening strips as sold under the trademark VELCRO.

Each flexible securing strap further comprises strap fastening means along the strap for fastening the strap to itself at first fastening locations 32, 32*a* and second fastening locations 34, 34*a* lengthwise of the strap and for securing a wire bundle to the plate. The strap fastening means is comprised of primary contact adhesive patches, one of which is shown at 38, and secondary contact adhesive patches 39, 39*a*, each having a corresponding cover sheet 40, 40*a* and 42, 42*a*. The term "fastening location" as used herein refers to a location on a strap to which a fastening means such as an adhesive patch is attached.

The adhesive patches are preferably located at the ends of the flexible securing straps. The primary contact adhesive patches 38, 38*a* are located at the same end 30, 30*a* of the flexible securing straps as strap attachment adhesive patches 36, 36*a* but on the opposite side thereof. The secondary contact adhesive patches 39, 39*a* are located on the same side of the flexible securing straps as strap attachment adhesive patches 36, 36*a* but at the opposite end thereof, as shown in FIG. 1. All cover sheets have upwardly bent ends to form pull tabs 44 to facilitate quick and easy removal thereof. To further facilitate the assembly process, each pair of cover sheets 40, 40*a* and 42, 42*a* may be color coded to indicate which cover sheets should be removed and which adhesive patches should be used for each stage of the harness assembly process.

Figure 4:
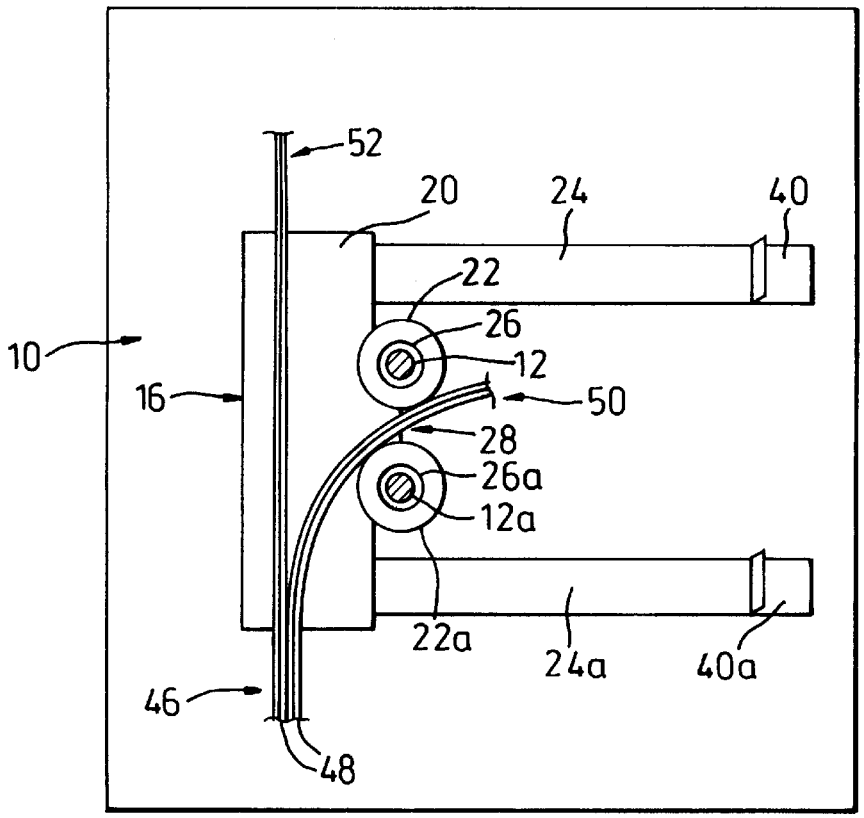
FIG. 4 is a top view of a harness breakout clip according to the invention as mounted on a layout board during first stage harness assembly.
Figure 5:
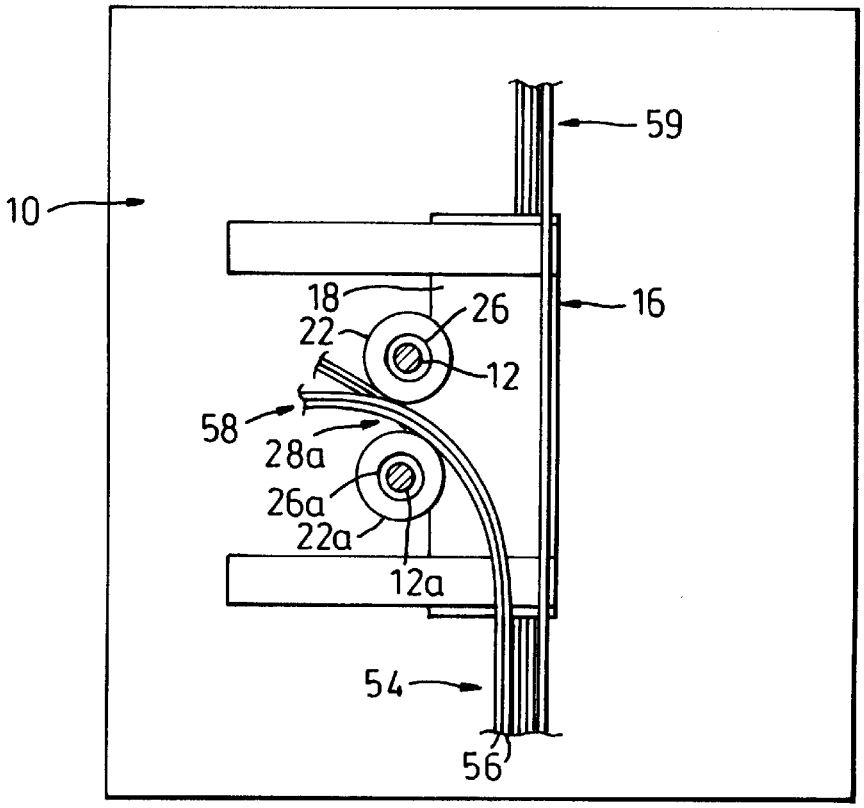
FIG. 5 is a top view of a harness breakout clip according to the invention as mounted on a layout board during second stage harness assembly.

Assembly of a wiring harness according to the present invention is commenced by mounting the harness breakout clip 14 on a layout board schematically shown at 10 in FIGS. 4 and 5. As shown in FIG. 4, the clip is mounted on the layout board by fitting the through bores 26, 26*a* of the locating posts over mounting pins 12, 12*a* which project from the layout board. The clip is first mounted on the layout board such that side 20 of the plate is exposed. A wire bundle 46 comprising wires 48 is then brought into contact with the exposed side of the plate and the locating posts such that the wire bundle is adjacent to but not channeled through the locating space 28. A plurality of the wires are then channeled between the locating posts through the locating space 28 to form a branch portion 50. The remaining wires of the wire bundle which are not channeled through the locating space form a reduced trunk portion 52 as shown in FIG. 4.

The wire bundle is then fastened to the plate as follows. First, the cover sheets 40, 40*a* are removed to expose the primary contact adhesive patches 38, 38*a*. Flexible securing strap 24*a* is then tightly wrapped once around the wire bundle 46 (the trunk portion) and the plate 16 and fastened to itself at a first fastening location 32 (FIG. 1) along the flexible securing strap by adhesive strip 38. Flexible securing strap 24 is then tightly wrapped once around the reduced trunk portion 52 and the plate and fastened to itself at a first fastening location 32*a* (FIG. 1) along the flexible securing strap by adhesive strip 38*a*. At this point, the first stage of harness assembly is complete and the harness may be removed from the layout board.

An additional wire bundle 54 comprising wires 56 may be attached to the opposite side of plate 16 during a second stage of harness assembly. To do so, the clip 14 is remounted on the pins on the layout board 10 with the first side 18 of the plate exposed as shown in FIG. 5. In a manner similar to that described above, a plurality of the wires 56 of the additional wire bundle 54 are channelled between locating posts 22 and 22*a* through the locating space 28*a* to form a branch portion 58 and a reduced trunk portion 59. The additional wire bundle is then secured to the plate 16 by removing cover sheets 42, 42*a* to expose secondary contact adhesive straps 39, 39*a* and wrapping the flexible securing straps 24, 24*a* once around the wires and fastening them to themselves at second fastening locations 34, 34*a*, as can be seen with reference to FIG. 1. At this point, the second stage of harness assembly is complete and the clip and assembled harness may be removed from the layout board. A side partial sectional view of a multiple bundle harness assembled in this manner is shown in FIG. 3. The same harness is shown in the side view of FIG. 2 with the wire bundles eliminated for purposes of illustration.

The exact position of fastening locations 32, 32*a* and 34, 34*a* along the length of the flexible securing straps may, of course, vary according to the intended application for the harness breakout clip. The exact position of fastening locations 32, 32*a* and 34, 34*a* along the length of the flexible securing straps for a particular harness breakout clip depends upon the combination of the length of the flexible securing straps, the width of the plate, and the girth of the wire bundles to be attached to the plate. FIG. 2 shows typical first and second fastening locations 32 and 34.

The completed harness may be mounted in an end product by fitting the through bores 26, 26*a* of the locating posts over mounting pins or bolts (not shown) projecting from the end product (not shown).

Figure 6:
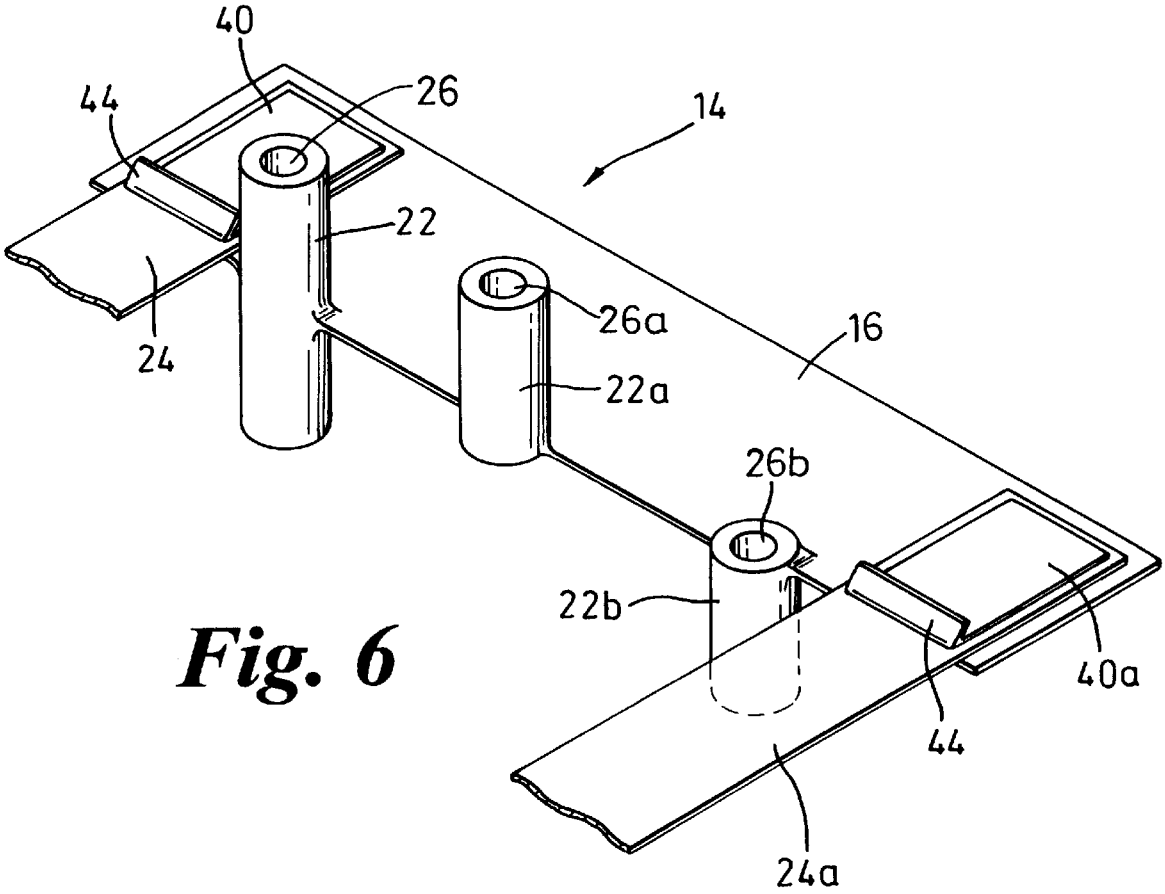
FIG. 6 is a perspective view of a harness breakout clip according to the invention showing locating spaces of different sizes.

A harness breakout clip having plural locating spaces of different sizes on a single clip allows wire bundles of substantially different girths to be attached to a single clip. In such a configuration only one locating post need project from both sides of the plate. FIG. 6 shows a configuration in which only one locating post, namely locating post 22, projects from both sides of the plate 16. Second locating post 22*a* and an additional locating post 22*b* project from opposite sides of the plate such that locating spaces 28, 28*a* of unequal size are formed. Additional locating post 22*b* is also provided with a through bore 26*b* to allow for mounting on a mounting pin. Although only one locating post need project from both sides of the plate, it is preferred that at least two spaced locating posts project from both sides of the plate to facilitate stable support of the clip on a support surface.

Figure 7:
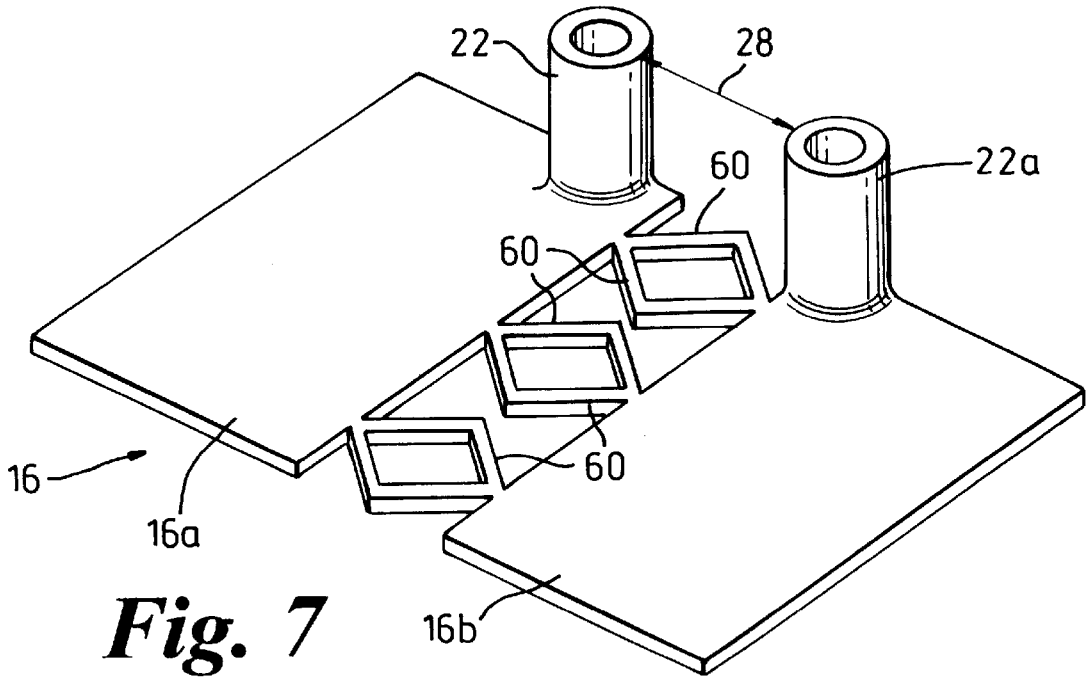
FIG. 7 is a perspective view of a harness breakout clip according to the invention showing a harness breakout clip having expansion means for varying the size of the locating space.

It is sometimes advantageous to include expansion means for expanding the length of the plate to vary the distance between a pair of locating posts and thereby vary the size of the locating space. This arrangement advantageously allows for accommodation of a broader range of wire bundle girths and accommodates variations in pin spacing on the layout board or mounting bolt locations in the finished product. In such an arrangement, as shown in FIG. 7, the plate 16 is subdivided into two planar sections 16*a* and 16*b*. Each planar section supports one of the locating posts 22, 22*a* and each planar section is integrally joined to the expansion means. The expansion means preferably comprises a plurality of yieldable members 60 formed of deformable plastic, such as polyamide formed by molding or stamping as an integral part of the plate 16. As shown in FIG. 7, the yieldable members 60 comprise portions angularly diverging from one edge of one section of plate 16 and being joined midway between the two plate sections.

By the application of pressure pulling the two plate sections apart, the midpoints of members 60 move towards each other, thereby increasing the distance between posts 22, 22*a*. Conversely, the two plate sections may be pushed together causing the midpoints to move apart, thereby decreasing the distance between the points. Straps 24 and 24*a* illustrated in FIG. 1 are affixed respectively to plates 16*a* and 16*b*.

Figure 8:
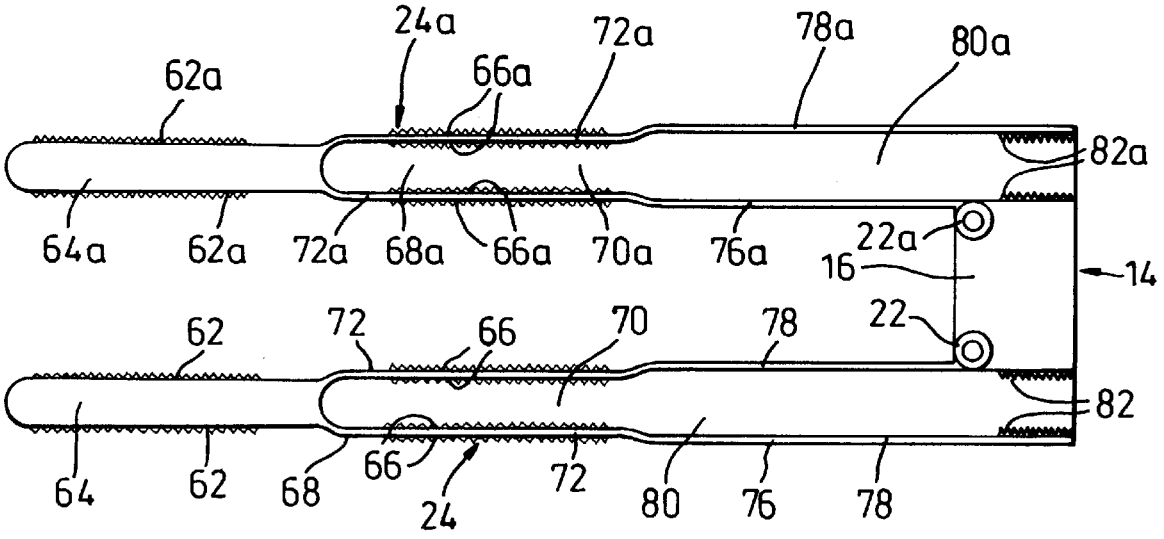
FIG. 8 is a plan view of an alternative embodiment of the invention.
Figure 9:
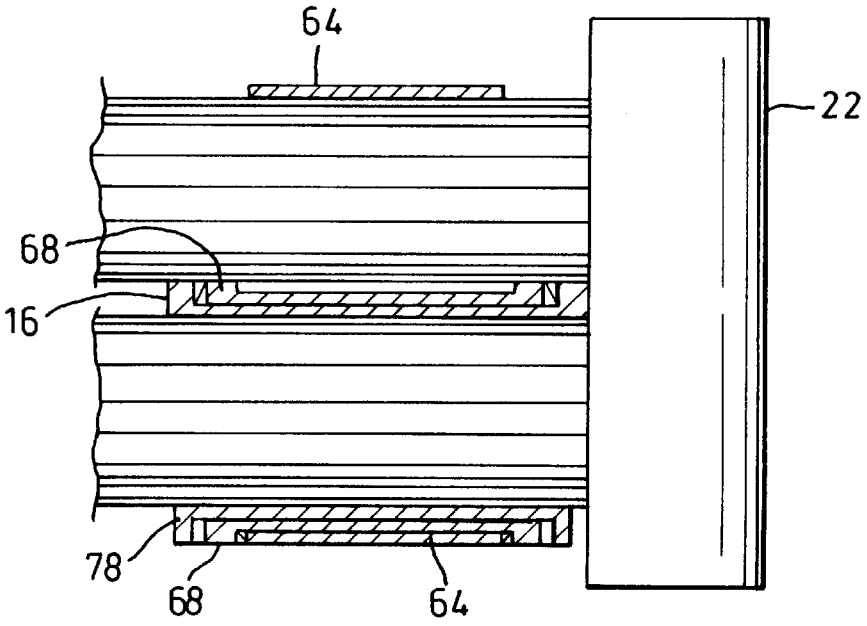
FIG. 9 is a sectional view on an enlarged scale with respect to FIG. 8 showing the clip of FIG. 8 wrapped around two bundles of wire.
Figure 10:
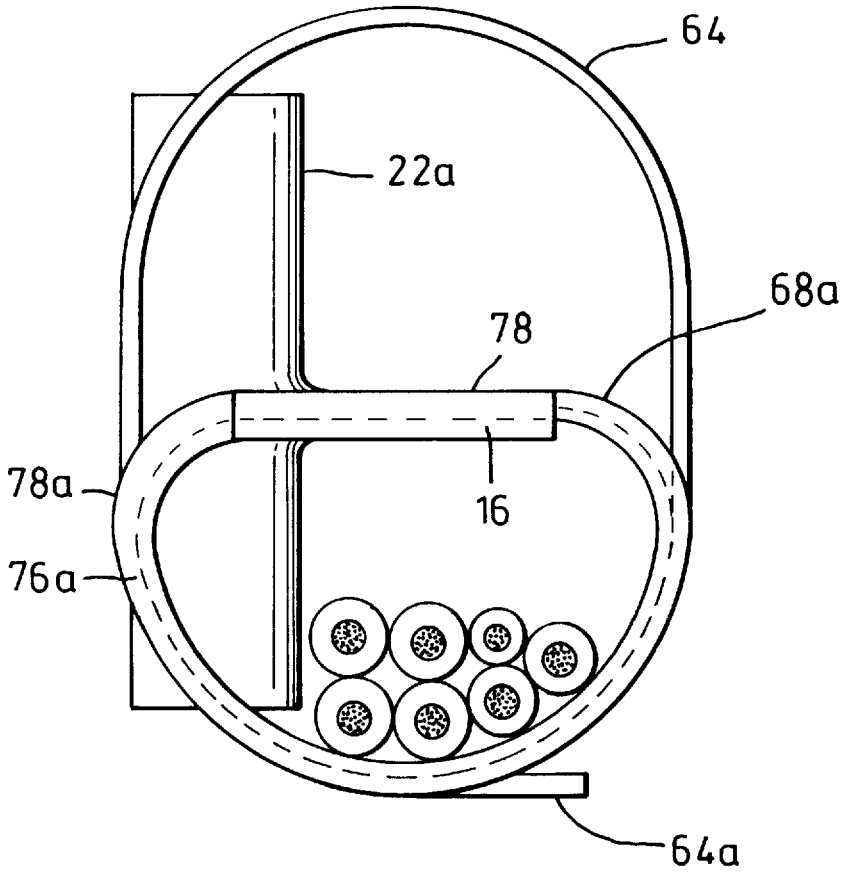
FIG. 10 is a side view similar to FIG. 2 showing the straps as wrapped around two bundles of wire with the wire bundles only partially illustrated.

In the embodiment of FIGS. 8–10 in which like numbers are used to designate like parts, clip 14 comprises integrally formed securing straps 24 and 24*a* extended from plate 16. As best illustrated in FIG. 8, straps 24 and 24*a* are provided with a first series of projecting points or barbs 62, 62*a* which project laterally outwardly from both side edges of distal end sections 64, 64*a*. A second series of barbs 66, 66*a* project from the side edges of intermediate sections 68, 68*a* of straps 24, 24*a*. Preferably, the intermediate sections 68, 68*a* are formed with a shallow recess 70, 70*a* defined by raised side edges 72, 72*a*, as can be seen with reference to FIGS. 8 and 9. In the intermediate sections, the barbs 66, 66*a* project both inwardly and outwardly from the raised side edges 72, 72*a*. Finally, the straps include sections 76, 76*a* proximal to and joining plate 16 which have raised side edges 78, 78*a*. A third series of barbs 80, 80*a* project inwardly from the raised side edges 78, 78*a*. The distal, intermediate and proximal sections are all relatively dimensioned in width so that the distal sections 64 nest within the recess 70 in the intermediate sections 68 with the barbs 62 and 66 in interlocking relation and the intermediate sections 68 nests within the recess 80 in the proximal sections 76 with barbs 74 and 82 in interlocking relationship. To increase resistance to separation, the barbs in each section may be angularly disposed in a direction away from the direction in which tension is applied.

FIG. 10 is a side elevational view similar to FIG. 2, illustrating the positioning of the straps on wire bundles secured on each side plate 16. According to FIG. 10, the proximal strap section 76*a* is wrapped around a bundle of wires, only a few of which are illustrated for purposes of clarity. The intermediate strap section 68 nests within the recess formed by raised side edges 78 and is fixed in place by the interlocking barbs 66 and 82. The proximal section 64 than is wrapped around the upper bundle which is clinched in place when the barbs extending from the sides of the proximal section 64 are interfitted with the barbs in the intermediate section 68, it being understood that the intermediate section 68 is nested within a recess in the proximal section 76.

From the foregoing, it will be seen that the present invention provides a novel, versatile, inexpensive wire harness breakout clip which may be used to quickly and conveniently locate, form and support multiple trunk and branch wire harnesses during multi-stage harness assembly. A harness breakout clip according to the present invention also provides post-assembly support for a wiring harness during transport of the harness from the point of assembly to a location where the harness will be integrated with an end product. A harness breakout clip according to the present invention further provides post-assembly support for a wiring harness after the harness is installed in an end product. Moreover, a wiring harness produced in accordance with the present invention reduces the need for repetitive wrapping motions and muscular and nerve injuries resulting therefrom.

What is claimed is:

1. A wiring harness breakout clip for forming and supporting the trunk and branch portions of a wire bundle comprising a wiring harness, said harness breakout clip being adapted to be mounted on a support surface, wherein said harness breakout clip comprises:

a substantially rigid plate having a surface for supporting the trunk portion of said wire bundle;

a pair of locating posts joined to and projecting transversely of the surface of said plate, said locating posts being spaced apart to form a locating space for a branch portion of said wire bundle, at least one of said locating posts having a through bore extending therethrough for receipt of a mounting pin ; and a pair of elongated flexible securing straps, each strap of said pair of flexible securing straps being joined to said plate in adjacent relation to one of said locating posts, said each strap comprising a plurality of strap fastening means arranged along said each strap for fastening said each strap to itself at spaced fastening locations along said each strap, said plurality of strap fastening means also for securing said wire bundle to said plate.

2. The harness breakout clip of claim 1, wherein said flexible securing straps are joined to said plate on opposite sides of said locating space.

3. The harness breakout clip of claim 2, wherein each of said plurality of strap fastening means comprises a patch of contact adhesive.

4. The harness breakout clip of claim 1, wherein said plate further comprises plural plate sections and separation means joined to said plate sections intermediate said locating posts for selectively varying the size of said locating space.

5. The harness breakout clip of claim 1, further including a third locating post spaced from said pair of locating posts, said third post being joined to and projecting transversely from said plate to form an additional locating space.

6. The harness breakout clip of claim 1, wherein said plate is subdivided into a pair of planar sections, each planar section of said pair of planar sections supporting one of said locating posts and further including separation means comprising yieldable members joined to said each planar section of said pair of planar sections, said yieldable members providing for varying the separation of said each planar section of said pair of planar sections.

7. The harness breakout clip of claim 6, wherein said yieldable members each include a first portion and a second portion integrally joined to and angularly diverging from each of said planar sections, said first and second portions being yieldably joined together substantially midway between said planar sections and being yieldable upon the application of force applied in the plane of said planar sections for selectively varying the size of said locating space.

8. The harness breakout clip of claim 7, wherein said locating posts project from both sides of said plate.

9. The harness breakout clip of claim 8, wherein said pair of locating posts is positioned along an edge surface of said plate.

10. The harness breakout clip of claim 1, wherein each of said pair of locating posts has a through bore extending along its longitudinal axis, further comprising a mounting pin for each said through bore, each said pin projecting from said support surface and being sized to fit within each said through bore.

11. The harness breakout clip of claim 10, wherein the locating posts project from both sides of said plate and said pair of flexible securing straps forming a plurality of loops for securing a plurality of wire bundles to said plate.

12. The harness breakout clip of claim 11, wherein said pair of locating posts is positioned along an edge surface of said plate.

13. The harness breakout clip of claim 11, wherein each strap of said pair of flexible securing straps comprises a distal section, an intermediate section and a proximal section, each of said distal, intermediate and proximal sections having a multiplicity of fastening projections extending therefrom, said projections on said intermediate section being subdivided into a first group movable into a position of interlocking engagement with said projections on said proximal section to form a first wrap for a first wire bundle disposed on one side of said plate, said projections on said intermediate section being further subdivided into a second group movable into a position of interlocking engagement with said projections on said distal section to form a second wrap for a second wire bundle disposed on an opposite side of said plate.

14. The harness breakout clip of claim 13, wherein said proximal section on said each strap has a first recess extending lengthwise thereof, said first recess being dimensioned to receive said intermediate section in nesting relationship, said fastening projections on said proximal section and said fastening projections comprising said first group being disposed to project laterally towards each other and into a position of interlocking engagement, said intermediate section on said each strap having a second recess extending lengthwise thereof, said second recess being dimensioned to receive said distal section in nesting relationship, said fastening projections comprising said second group and said fastening projections on said distal section being disposed to project laterally towards each other into a position of interlocking engagement.

* * * * *